US010490938B2

(12) United States Patent
Probert et al.

(10) Patent No.: US 10,490,938 B2
(45) Date of Patent: Nov. 26, 2019

(54) ELECTRICAL CONNECTOR WITH ASSIST LEVER

(71) Applicant: Lear Corporation, Southfield, MI (US)

(72) Inventors: Deborah Probert, Farmington Hills, MI (US); Michael Glick, Farmington Hills, MI (US); Reinhard Pusch, Novi, MI (US); David Menzies, Linden, MI (US); Bhupinder Rangi, Novi, MI (US); Sheikh Habibur Rahman, Macomb, MI (US); Paul Castellani, Sterling Heights, MI (US); Michael Borowski, Garden City, MI (US)

(73) Assignee: Lear Corporation, Southfield, MI (US)

( * ) Notice: Subject to any disclaimer, the term of this patent is extended or adjusted under 35 U.S.C. 154(b) by 57 days.

(21) Appl. No.: 15/789,363

(22) Filed: Oct. 20, 2017

(65) Prior Publication Data

US 2019/0123485 A1 Apr. 25, 2019

(51) Int. Cl.
*H01R 13/629* (2006.01)
*H01R 13/502* (2006.01)

(52) U.S. Cl.
CPC . *H01R 13/62938* (2013.01); *H01R 13/62966* (2013.01); *H01R 13/502* (2013.01); *H01R 13/62955* (2013.01); *H01R 2201/26* (2013.01)

(58) Field of Classification Search
CPC ..... H01R 13/62938; H01R 13/62955; H01R 13/62944; H01R 13/6295; H01R 13/506; H01R 13/62977; H01R 13/641; H01R 13/62927; H01R 13/62933; H01R 13/639; H01R 13/6272
See application file for complete search history.

(56) References Cited

U.S. PATENT DOCUMENTS 6,325,647 B1 12/2001 May et al.
6,368,125 B1 4/2002 Gundermann et al.
6,540,532 B1 * 4/2003 Martin ..... H01R 13/62944 439/157
6,644,992 B2 * 11/2003 Maegawa ..... H01R 13/62938 439/157
6,655,971 B2 * 12/2003 Maegawa ..... H01R 13/62933 439/157
6,755,674 B2 * 6/2004 Fujii ..... H01R 13/506 439/157

(Continued)

*Primary Examiner* — Edwin A. Leon
*Assistant Examiner* — Matthew T Dzierzynski
(74) *Attorney, Agent, or Firm* — MacMillan, Sobanski & Todd, LLC

(57) ABSTRACT

An electrical connector includes a first housing. A second housing is moveable relative to the first housing. The electrical connector includes a lever mounted on the first housing for relative rotational movement. The lever may move between a pre-stage position and a final position. The lever engages the second housing to move the second housing linearly between a pre-stage position and a seated position relative to the first housing. The electrical connector includes a pre-lock that retains the lever in the pre-stage position relative to the first housing. A pre-lock release on the second housing releases the pre-lock when the second housing is in the pre-stage position relative to the first housing. Releasing the pre-lock allows movement of the lever relative to the first housing.

11 Claims, 14 Drawing Sheets

(56) References Cited

U.S. PATENT DOCUMENTS

| | | | | |
|---|---|---|---|---|
| 6,767,231 | B1 * | 7/2004 | Martin | H01R 13/62944 439/157 |
| 6,857,892 | B2 | 2/2005 | McLauchlan et al. | |
| 7,044,758 | B2 | 5/2006 | Deno et al. | |
| 7,137,835 | B2 * | 11/2006 | Shiga | H01R 13/62938 439/157 |
| 7,137,844 | B2 | 11/2006 | Flowers et al. | |
| 7,175,451 | B2 | 2/2007 | Shuey | |
| 7,384,285 | B2 | 6/2008 | Patterson et al. | |
| 7,407,396 | B2 | 8/2008 | Dillon et al. | |
| 7,562,114 | B2 | 7/2009 | Nakagawa et al. | |
| 7,726,988 | B2 | 6/2010 | Martin | |
| 7,749,004 | B2 * | 7/2010 | Shuey | H01R 13/62955 439/157 |
| 7,922,503 | B1 | 4/2011 | Kobayashi et al. | |
| 8,219,579 | B2 | 7/2012 | Ratiner et al. | |
| 8,979,567 | B2 | 3/2015 | Kamiya et al. | |
| 9,281,614 | B1 | 3/2016 | Bonucci et al. | |
| 9,472,895 | B2 * | 10/2016 | Kataoka | H01R 13/62938 |
| 9,774,127 | B2 * | 9/2017 | Yamaki | H01R 13/506 |
| 2003/0190836 | A1 * | 10/2003 | Yamashita | H01R 13/62938 439/489 |
| 2005/0148221 | A1 * | 7/2005 | Miyamoto | H01R 13/62955 439/157 |
| 2006/0040535 | A1 * | 2/2006 | Koshy | H01R 13/62977 439/157 |
| 2006/0270257 | A1 * | 11/2006 | Duval | H01R 13/62938 439/157 |
| 2008/0248664 | A1 * | 10/2008 | Shibata | H01R 13/62938 439/157 |
| 2009/0023317 | A1 * | 1/2009 | Mizoguchi | H01R 13/62938 439/157 |

* cited by examiner

ELECTRICAL CONNECTOR WITH ASSIST LEVER

BACKGROUND OF THE INVENTION

The present invention relates to an electrical connector with an assist lever that may be used to mate two halves of the electrical connector. More specifically, this invention relates to an electrical connector with an assist lever and features that allow for a reduction in size of the electrical connector.

Vehicles, such as passenger cars, include an increasing number of electrical devices. Features such as lights, cameras, sensors, motors, blowers, and heaters are used to provide comfort or safety features for passengers of the vehicles. In order to operate these electronic components, electrical connections are provided in the vehicle to transfer operating power and control signals. During assembly of a vehicle, components are typically put in position, and multiple wires are run together in a wire harness. Each of the individual wires can be connected to a separate electrical terminal. Multiple electrical terminals may be placed in a connector that is mated with a corresponding connector in order to make electrical connections to all the wires in a wire harness simultaneously. Connecting multiple terminals simultaneously increases the amount of force an operator has to exert to mate the connectors. In order to remove the need for the operator to use a separate tool, it is known to use lever actuated connectors, such as the one described in U.S. Pat. No. 9,281,614.

As the number of electrical components in vehicles continues to increase, there is a desire to fit an increasing number of electrical connections in confined spaces within the vehicles. As a result, it would be advantageous to have an electrical connector that allows a greater number of electrical terminals to be fit in a location, while still being easy for the operator to use.

SUMMARY OF THE INVENTION

This invention relates to an electrical connector. The electrical connector includes a first housing. A second housing is moveable relative to the first housing. The electrical connector includes a lever mounted on the first housing for relative rotational movement. The lever may move between a pre-stage position and a final position. The lever engages the second housing to move the second housing linearly between a pre-stage position and a seated position relative to the first housing. The electrical connector includes a pre-lock that retains the lever in the pre-stage position relative to the first housing. A pre-lock release on the second housing releases the pre-lock when the second housing is in the pre-stage position relative to the first housing. Releasing the pre-lock allows movement of the lever relative to the first housing.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
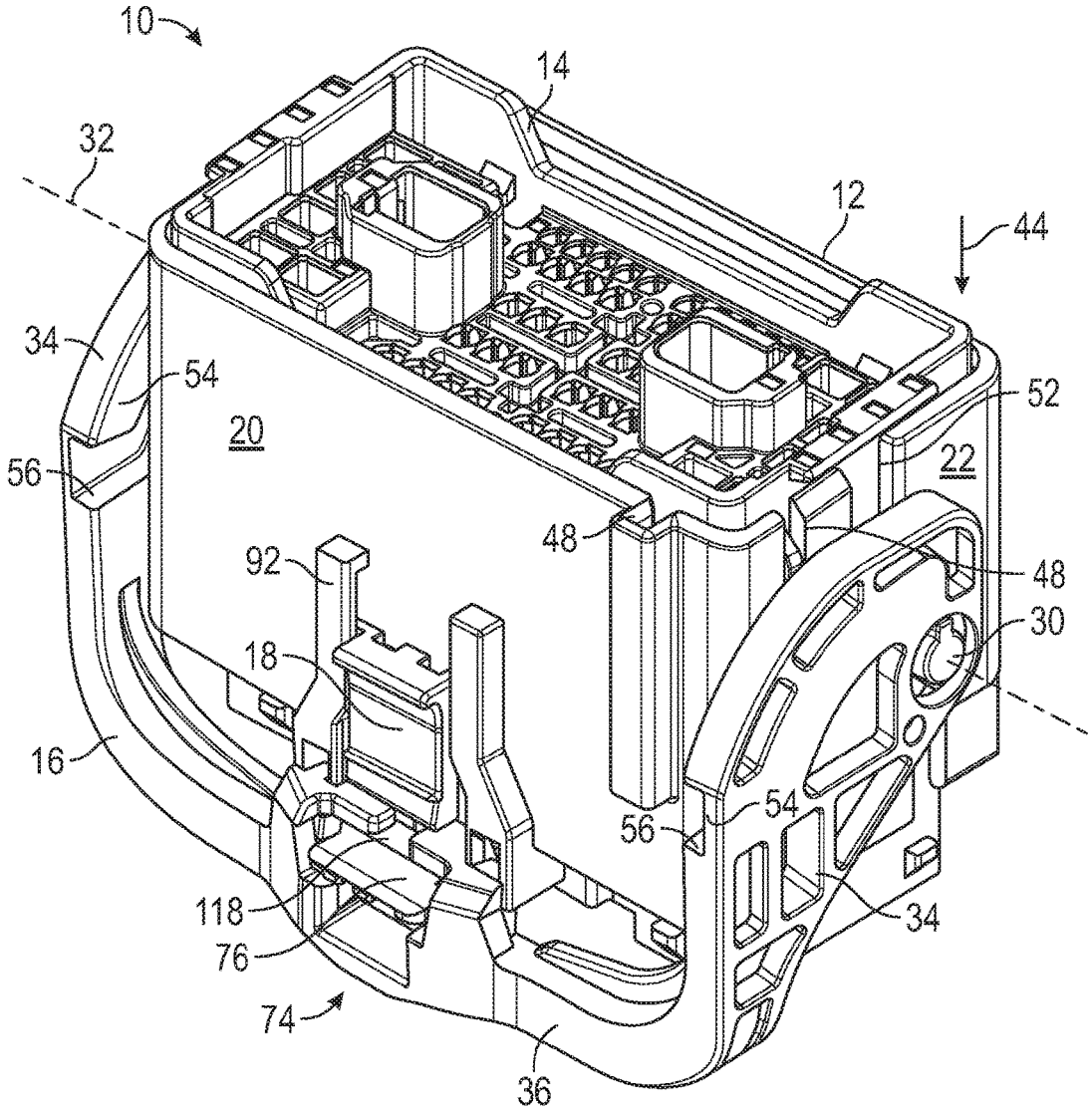
FIG. 1 is a perspective view of an assembled electrical connector.
Figure 2:
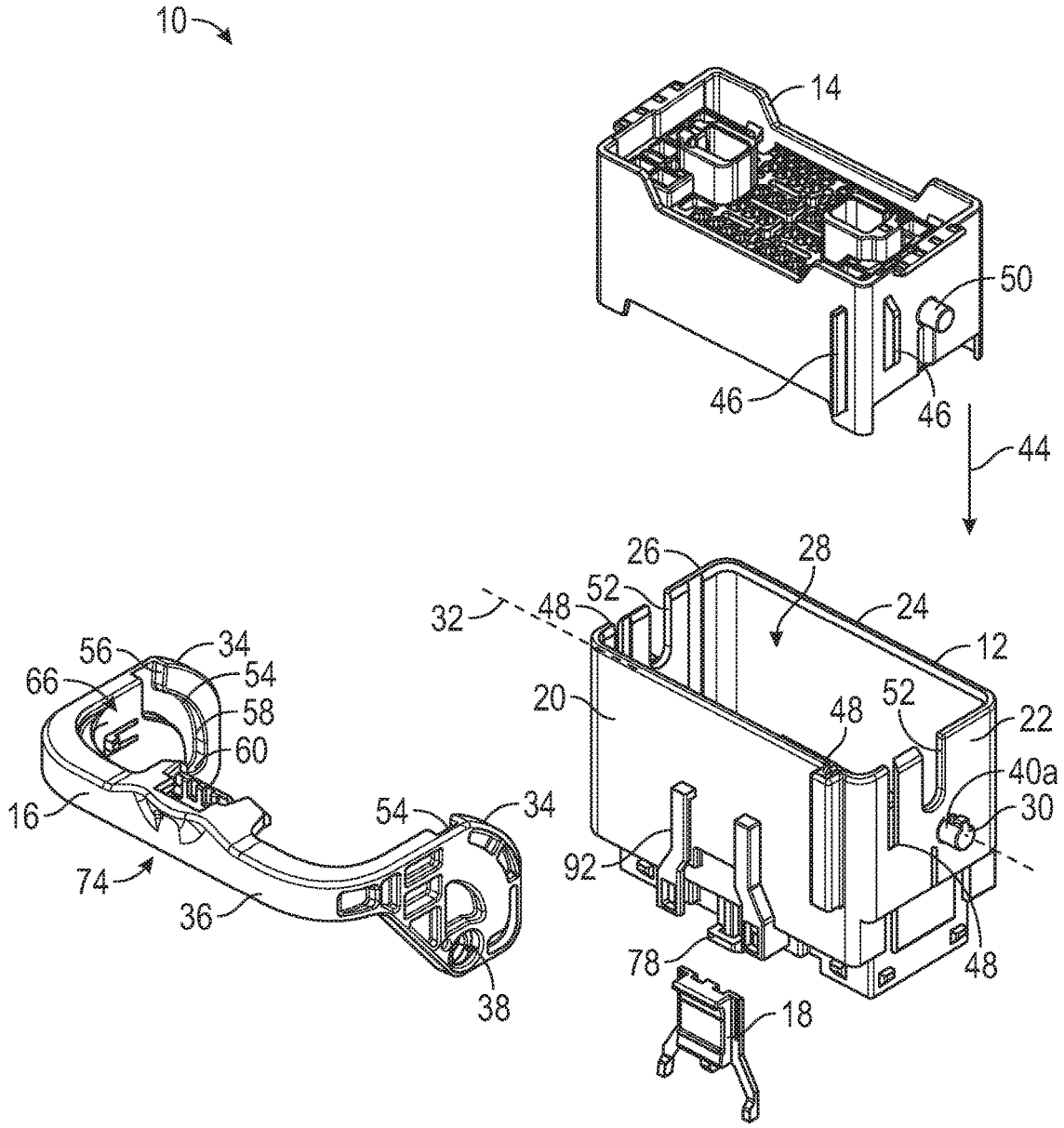
FIG. 2 is an exploded view of the electrical connector illustrated in FIG. 1.

Referring now to the drawings, there is illustrated in FIG. 1 an electrical connector, indicated generally at 10. The electrical connector 10 is shown in an assembled, connected position in FIG. 1. Referring to FIG. 2, an exploded, perspective view of the electrical connector 10 is shown. The electrical connector 10 includes a first housing 12 and a second housing 14. The first housing 12 is adapted to hold a plurality of electrical terminals (not shown) and the second housing 14 is adapted to hold a plurality of corresponding electrical terminals (not shown). The illustrated first housing 12 can accommodate up to 62 male electrical terminals, but may accommodate any desired number, type, or size of electrical terminal. Similarly, the illustrated second housing 14 can accommodate up to 62 female electrical terminals, but may accommodate any desired number, type, and size of electrical terminal.

The electrical connector 10 includes a lever 16 mounted on the first housing 12 for relative rotational movement. The lever 16 may be moved by an operator to mate the first housing 12 and the second housing 14, as described below. The electrical connector 10 also includes a connector position assurance 18. The connector position assurance 18 is mounted on the first housing 12 for relative sliding movement. The connector position assurance 18 may be used by the operator to confirm that the lever 16 is in a final position relative to the first housing 12, as described below.

The illustrated first housing 12 is molded from plastic, but may be made of any desired material and by any desired process. The first housing 12 includes side walls 20, 22, 24, and 26 that define an interior space, indicated generally at 28. The illustrated first housing 12 has four side walls 20, 22, 24, and 26 that define a generally rectangular-shaped interior space 28, but may have any desired number of side walls and any desired shape interior space 28. The first housing 12 includes two axle posts 30 (one is visible in FIG. 2). The illustrated axle posts 30 extend outwardly from opposed side walls 22 and 26, but may be in any desired location on the first housing 10. The axle posts 30 extend along and define a lever axis 32.

Figure 3:
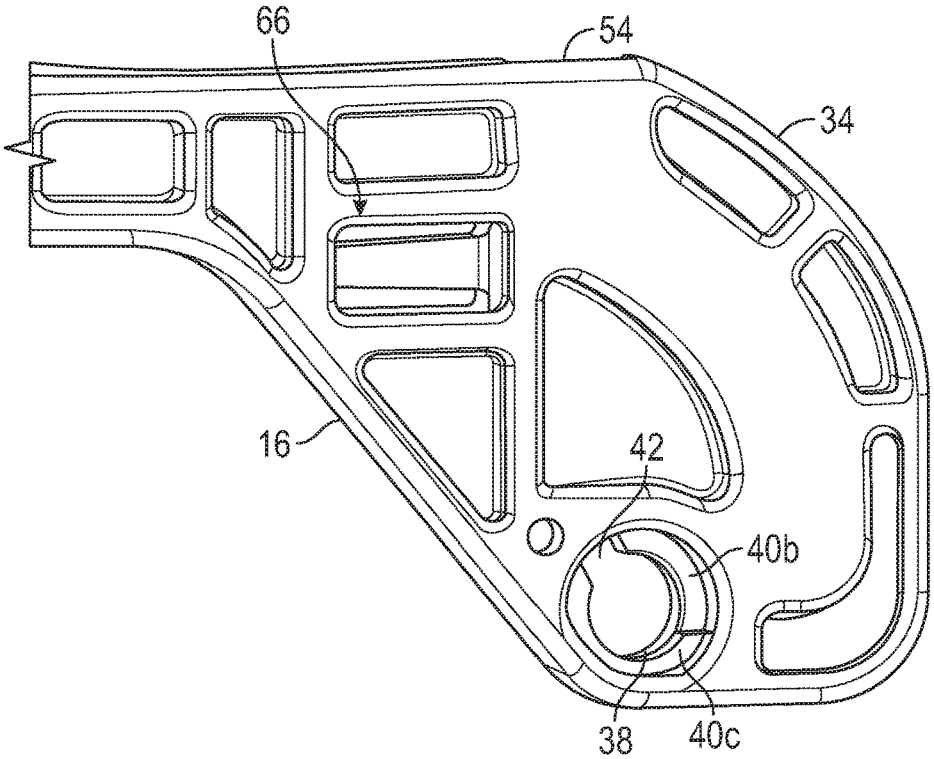
FIG. 3 is an enlarged, detail view of a lever arm of a lever illustrated in FIG. 2.
Figure 4:
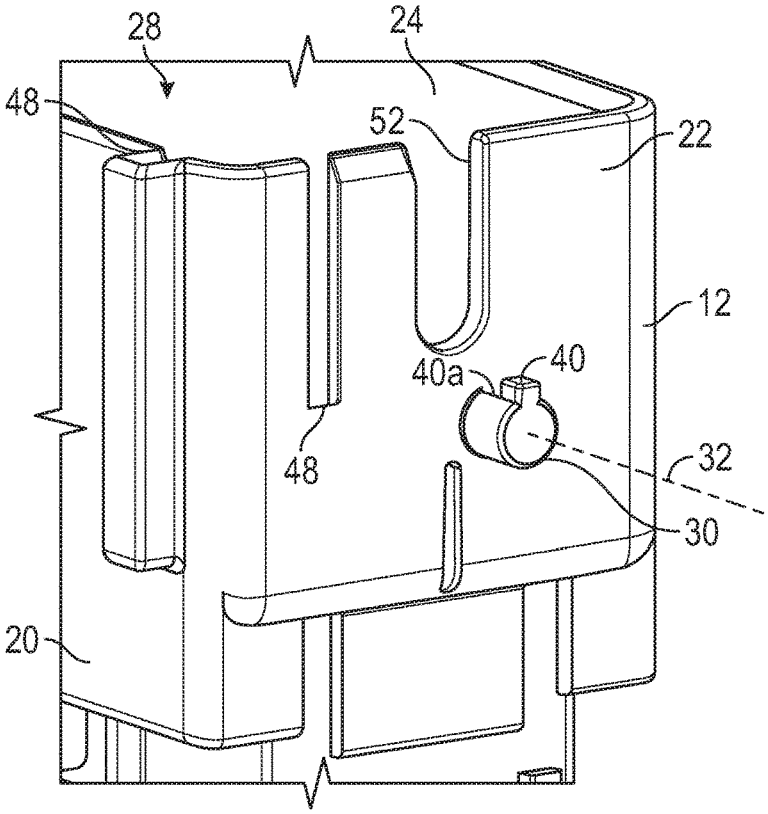
FIG. 4 is an enlarged, detail view of an axle post of a first housing illustrated in FIG. 2.

The illustrated lever 16 is molded from plastic, but may be made of any desired material and by any desired process. The illustrated lever 16 includes two lever arms 34 connected by a handle 36. The two illustrated lever arms 34 are mirror-images of each other, but may have any desired shapes. Each lever arm 34 includes an axle opening 38 (one is visible in FIG. 2). Referring to FIG. 3, an enlarged, detail view of the lever arm 34 including the axle opening 38 is shown. The illustrated axle opening 38 extends completely through the lever arm 34 and has a circular cross-sectional shape. However, the axle opening 38 may have any desired size and shape. Referring to FIG. 4, an enlarged, detail view of the side wall 22 of the first housing 12 is shown. The illustrated axle post 30 has a circular cross-sectional shape and is smaller than the axle opening 38. However, the axle post 30 may have any desired shape and size. The axle post 30 includes a flange 40 that extends from the axle post 30 generally perpendicular to the lever axis 32. The lever arm 34 includes a flange opening 42 that extends from the axle opening 38. The lever 16 may be connected to the first housing 12 by orienting the lever 16 so that the axle post 30 enters the axle opening 38 while flange 40 can pass through the flange opening 42. The lever 16 may be flexed in order to allow each axle post 30 to enter the axle opening 38 on the lever arm 34, and the resilient lever 16 will rebound to its illustrated shape after installation. As clearly shown in FIGS. 2, 4, and 19, recesses 40*a* are defined between the first housing 12 and each of the flanges 40 that extend from the axle posts 30 provided on the first housing 12. Also, as clearly shown in FIGS. 1, 5, and 6-9, respective portions of the lever arms 34 extend into the recesses 40*a* when the lever 16 is connected to the first housing 12. As clearly shown in FIGS. 3 and 6-9, the axle openings 38 provided in the lever arms 34 include respective ledges 40*b* that engage the flanges 40 that extend from the axle posts 30 provided on the first housing 12. As also clearly shown in FIGS. 3 and 6-9, the axle openings 38 provided in the lever arms 34 additionally include respective stops 40*c* that engage the flanges 40 that extend from the axle posts 30 provided on the first housing 12.

Figure 5:
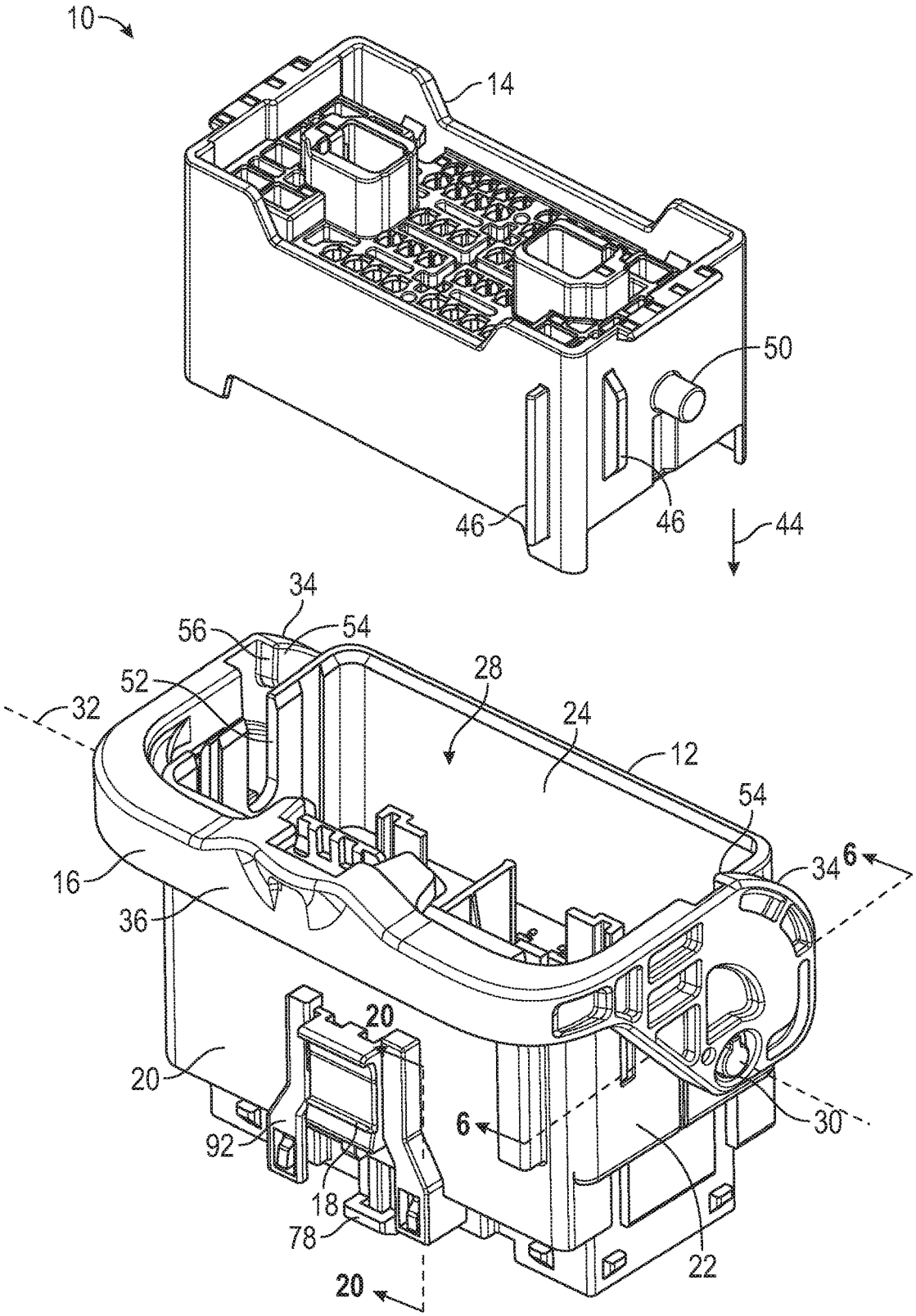
FIG. 5 is a perspective view of the electrical connector from FIG. 1, shown with a second housing separate from the first housing.

Referring to FIG. 5 a perspective view of the electrical connector 10 is shown with the lever 16 connected to the first housing 12. The lever 16 is shown in a pre-stage position relative to the first housing 12. The second housing 14 is shown positioned for insertion into the interior space 28 of the first housing 12. The illustrated second housing 14 is molded from plastic, but may be made of any desired material and by any desired process. The second housing 14 has a generally rectangular outer shape, and is adapted to fit into the interior space 28 by moving in an insertion direction 44 toward the first housing 12.

The illustrated second housing 14 includes a plurality of guide elements 46 (two are visible in FIG. 5). The illustrated guide elements are ribs 46 that extend outwardly from the second housing 14. The illustrated guide elements 46 have an elongate shape and extend in the insertion direction 44. However, the guide elements 46 may have any desired shape and be in any desired location on the second housing 14. As best seen in FIG. 2, the first housing 12 includes a plurality of cooperating guide elements 48. The illustrated cooperating guide elements 48 are guide channels 48 located in three of the side walls 20, 22, and 26 that extend parallel to the insertion direction 44. However, the cooperating guide elements 48 may have any desired shape and be in any desired location. The guide elements 46 and the cooperating guide elements 48 serve as a poka-yoke to prevent the operator from incorrectly positioning the second housing 14 relative to the first housing 12 during assembly. Additionally, the guide elements 46 and the cooperating guide elements 48 serve to maintain the proper alignment between the second housing 14 and the first housing 12 during assembly.

As seen in further reference to FIG. 2, the second housing 14 includes two travel pegs 50 (one is visible in FIG. 2). The illustrated travel pegs 50 extend outwardly from opposed sides of the second housing 14, but may be on any desired location on the second housing 14. The illustrated travel pegs 50 have circular cross-sectional shapes, but may have any desired shape. Two of the opposed side walls 22 and 26 of the first housing 12 include respective peg channels 52. The illustrated peg channels 52 pass completely through the respective side walls 22 and 26. However, the peg channels 52 may be any desired size. The peg channels 52 extend parallel to the insertion direction 44 and, during mating of the second housing 14 with the first housing 12, one of the travel pegs 50 is located in each of the peg channels 52.

Figure 6:
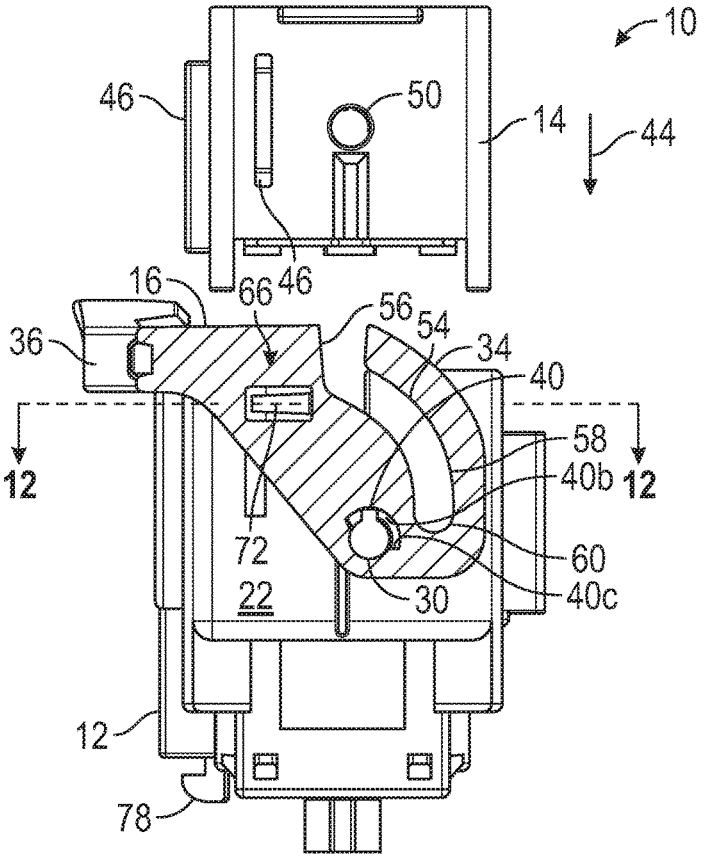
FIG. 6 is a cross-sectional view taken along line 6-6 of FIG. 5.

Each of the lever arms 34 includes a pull channel 54 (one is visible in FIG. 2). The illustrated pull channels 54 include a straight insertion section 56 and an arcuate pull section 58. Referring now to FIG. 6, a cross-sectional view taken along the line 6-6 of FIG. 5 is shown. The illustrated cross-section is taken through the lever arm 34 so that the pull channel 54 is visible. As shown, the pull section 58 extends from the insertion section 56 to a channel end 60, with the channel end 60 being closer to the lever axis 32 than the insertion section 56.

Figure 7:
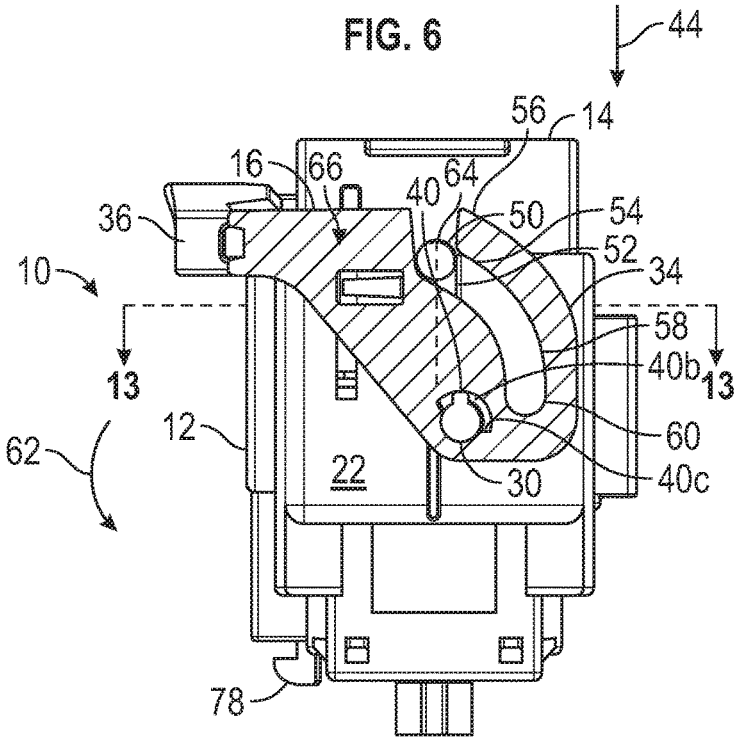
FIG. 7 is a cross-sectional view similar to that illustrated in FIG. 6, shown with the second housing in a pre-stage position relative to the first housing.

Referring now to FIG. 7, a cross-sectional view similar to that illustrated in FIG. 6 is illustrated, with the second housing 14 shown in a pre-stage position relative to the first housing 12. The second housing 14 may be placed in the pre-stage position by the operator moving the second housing 14 in the insertion direction 44 toward the first housing 12 so that one of the travel pegs 50 is located in each of the pull channels 54 of the lever 16. Each travel peg 50 is also located in one of the peg channels 52 of the first housing 12.

Figure 8:
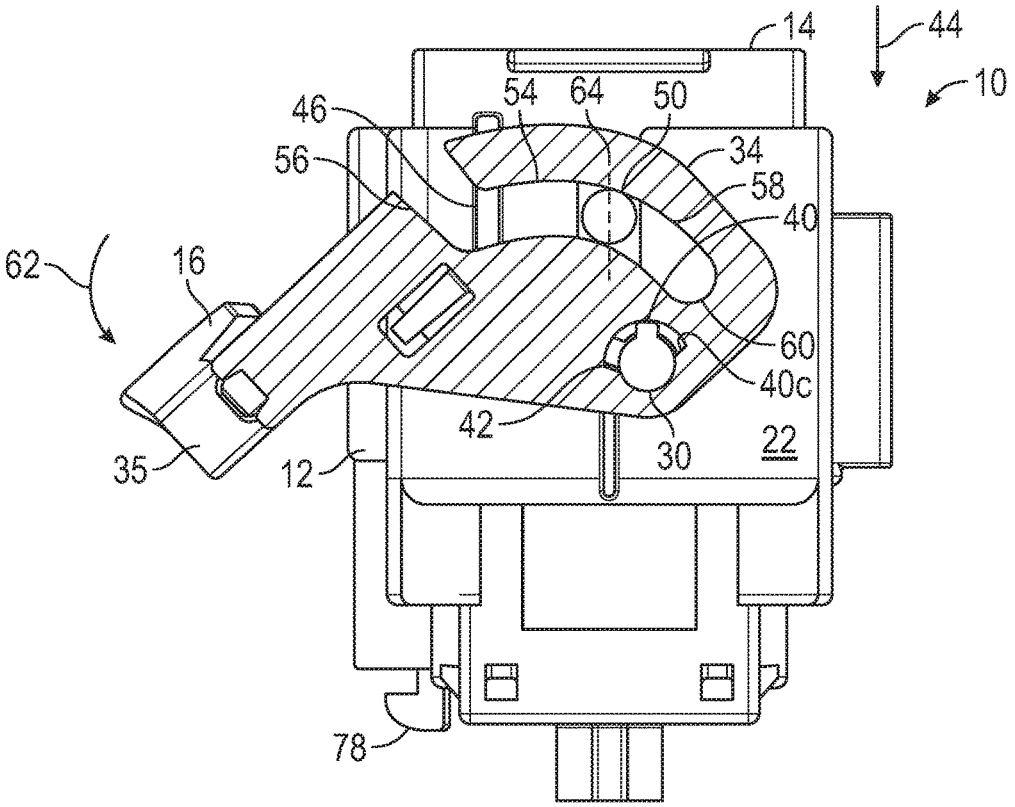
FIG. 8 is a cross-sectional view similar to that illustrated in FIG. 7, shown with the lever moved relative to the first housing to an intermediate position.

Referring to FIG. 8, a cross-sectional view similar to that illustrated in FIG. 7 is illustrated, with the lever 16 shown rotated relative to the first housing 12 from the pre-stage position in a mate direction 62. The lever 16 is moved in the mate direction 62 by rotating the handle 36 about the lever axis 32 so that the travel peg 50 enters the pull section 58 of the pull channel 54. As the lever 16 is rotated in the mate direction 62, each travel peg 50 engages the respective lever arm 34 in the respective pull section 58. As the lever arm 34 is moved relative to the travel peg 50, the travel peg 50 is pulled closer to the lever axis 32. As the travel pegs 50 are pulled in the insertion direction 44, they are retained in the respective peg channels 52 of the first housing 12 so that the travel pegs 50 move along a peg path 64. The movement of the travel pegs 50 causes the second housing 14 to be moved in the insertion direction 44 relative to the first housing 12. The interaction of the guide elements 46 and the cooperating guide elements 48 serves to maintain the proper alignment between the second housing 14 and the first housing 12 during this movement. As previously described, the illustrated guide elements 46 have an elongate shape and extend in the insertion direction 44. As a result, the guide elements 46 and the cooperating guide elements 48 serve to maintain the proper alignment between the second housing 14 and the first housing 12 during the travel through the whole length of the peg path 64.

Figure 9:
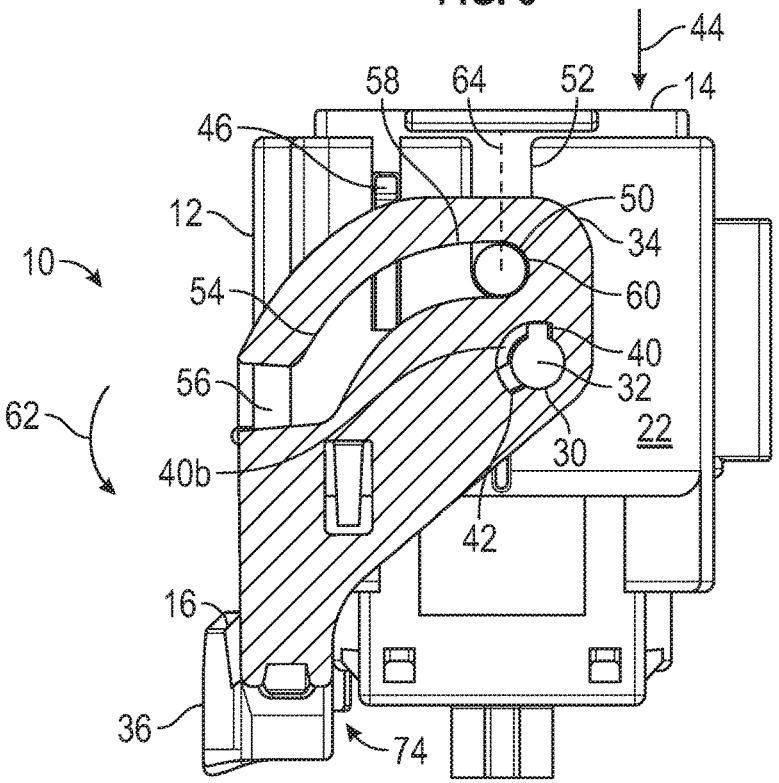
FIG. 9 is a cross-sectional view similar to that illustrated in FIG. 8, shown with the lever moved relative to the first housing to a final position.

Referring to FIG. 9, a cross-sectional view similar to that illustrated in FIG. 8 is shown, with the lever 16 rotated relative to the first housing 12 in the mate direction 62 to a final position. The second housing 14 is also shown in a seated position relative to the first housing 12. FIG. 9 illustrates the electrical connector 10 in the assembled, connected position that is also illustrated in FIG. 1.

Figure 10:
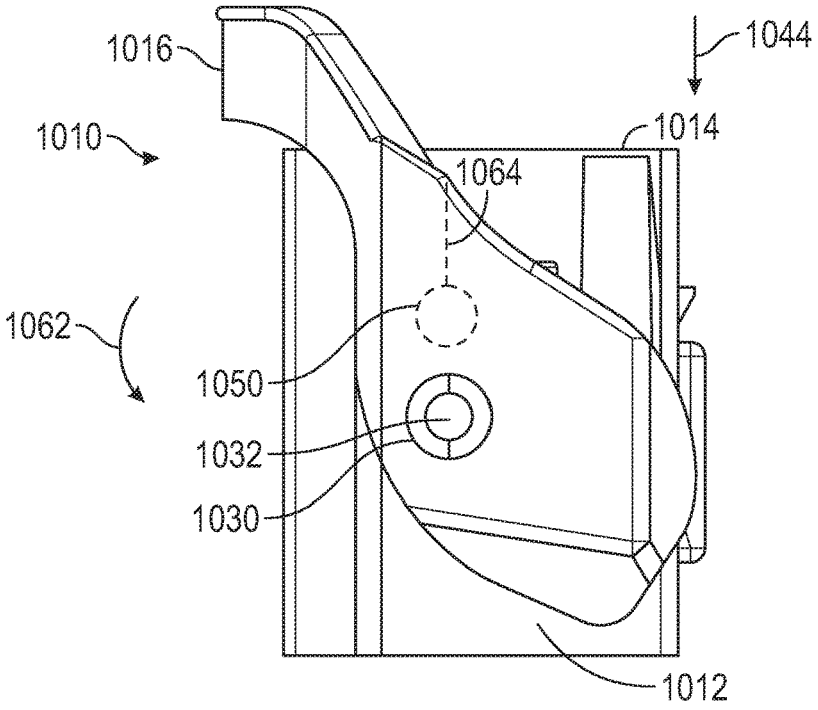
FIG. 10 (Prior Art)
FIG. 10 is a side view of a prior-art electrical connector with a lever.

Referring to FIG. 10, a side, plan view of a prior art electrical connector, indicated generally at 1010, is shown. The prior art electrical connector 1010 includes a first housing 1012 and a second housing 1014. A lever 1016 is mounted on the first housing 1012 for rotation about a lever axis 1032, which is defined by axle posts 1030. The lever 1016 may be moved in a mate direction 1062 in order to pull travel pegs 1050 (one is indicated in hidden line) on the second housing 1014 in an insertion direction 1044 in order to mate the first housing 1012 and the second housing 1014. The travel peg 1050 moves along a peg path 1064. As shown, the prior art peg path 1064 passes through the lever axis 1032. By aligning the peg path 1064 with the lever axis 1032, the second housing 1014 is drawing straight down into the first housing 1012, which helps prevent misalignment of the first housing 1012 and the second housing 1014.

Referring back to FIG. 9, it can be seen that the peg path 64 of the electrical connector 10 does not pass through the lever axis 32. Rather, the lever axis 32 is moved away from the peg path 64 so that the peg path 64 is located between the lever axis 32 and the handle 36 of the lever 16. As a result, the operator gains improved leverage when mating the first housing 12 and the second housing 14.

The first housing 12 and the second housing 14 of the electrical connector 10 may be disconnected by reversing the previously described process. With the connector in the assembled, connected position illustrated in FIG. 9, the lever 16 may be moved from the final position opposite the mate direction 62 toward the pre-stage position. As the lever 16 is moved to the intermediate position illustrated in FIG. 8, the travel pegs 50 are moved opposite the insertion direction 44 along the peg path 64 by engagement with the peg channel 52. This also moves the second housing 14 opposite the insertion direction 44 relative to the first housing 12. Further movement of the lever 16 opposite the mate direction 62 brings the lever 16 to the pre-stage position illustrated in FIG. 7. At this point the second housing 14 is in the pre-stage position and the operator may remove the second housing 14 from the first housing 12 by moving the travel pegs 50 through the insertion section 56 of the respective pull channel 54. This condition of the electrical connector is illustrated in FIG. 6.

The first housing 12 and the second housing 14 of the electrical connector 10 may be disconnected by reversing the previously described process. With the electrical connector 10 in the assembled, connected position illustrated in FIG. 9, the lever 16 may be moved from the final position opposite the mate direction 62 toward the pre-stage position. As the lever 16 is moved to the intermediate position illustrated in FIG. 8, the travel pegs 50 are moved opposite the insertion direction 44 along the peg path 64 by engagement with the peg channel 52. This also moves the second housing 14 opposite the insertion direction 44 relative to the first housing 12. Further movement of the lever 16 opposite the mate direction 62 brings the lever 16 to the pre-stage position illustrated in FIG. 7. At this point, the second housing 14 is in the pre-stage position, and the operator may remove the second housing 14 from the first housing 12 by moving the travel pegs 50 through the insertion section 56 of the respective pull channel 54. This condition of the electrical connector 10 is illustrated in FIG. 6.

Figure 11:
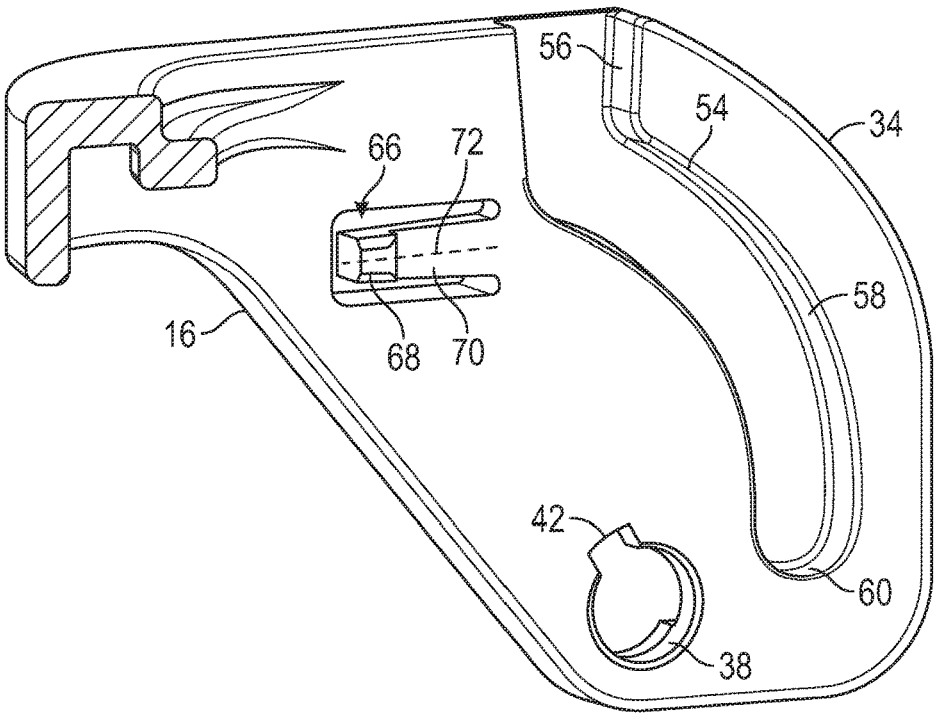
FIG. 11 is an enlarged, detail view of a pre-lock of the lever illustrated in FIG. 2.
Figure 12:
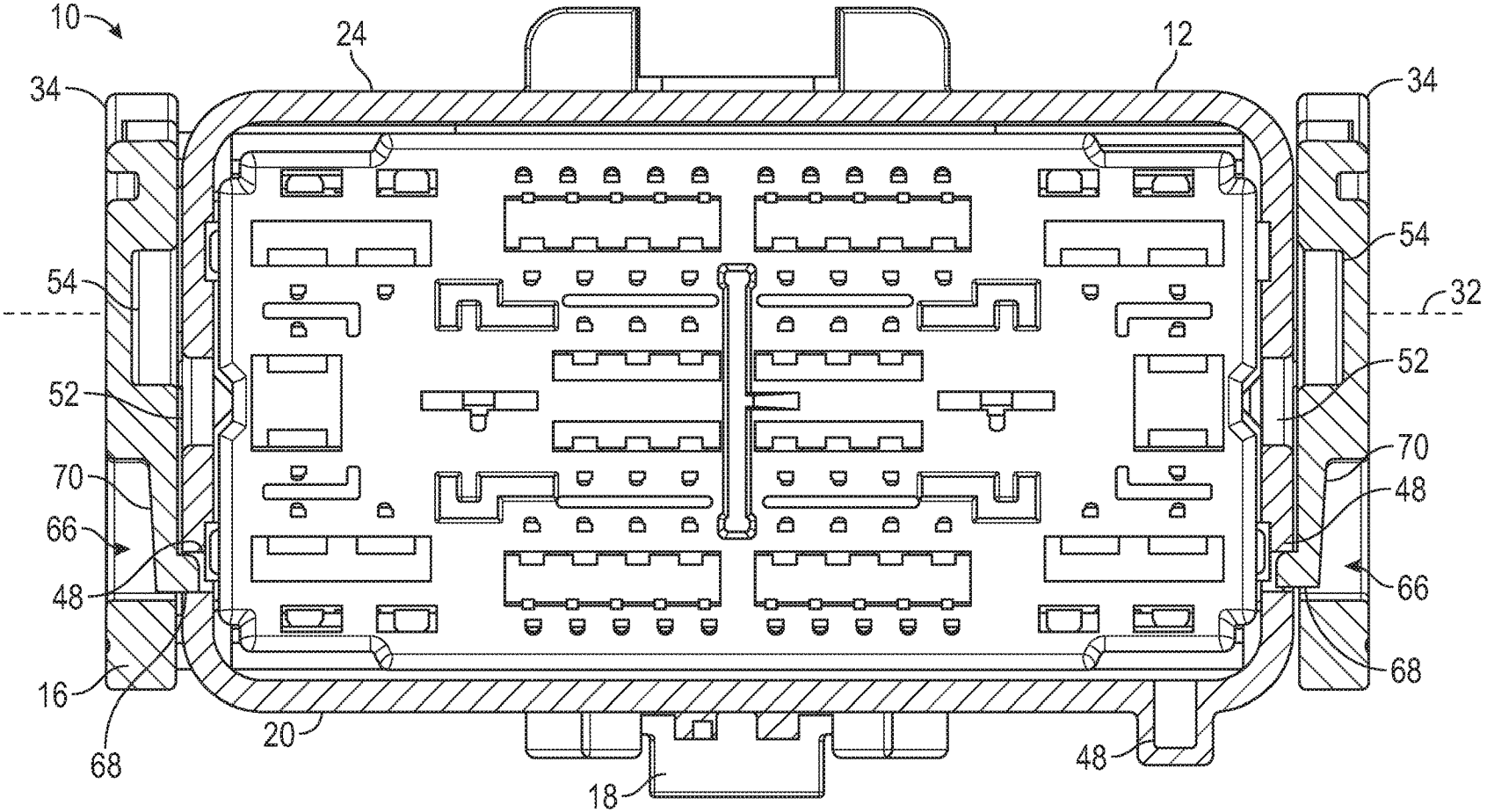
FIG. 12 is a cross-sectional view of the first housing, taken along line 12-12 of FIG. 6.

The illustrated electrical connector 10 includes a pre-lock, indicated generally at 66, that detains the lever 16 in the pre-stage position relative to the first housing 12 until the second housing 14 is in the pre-stage position. Referring to FIG. 11, an enlarged perspective view of one of the lever arms 34 is shown with a portion of the pre-lock 66 visible. The illustrated lever 16 includes a biased pre-lock tab 68. The illustrated pre-lock tab 68 is located on a resilient pre-lock arm 70 that extends from the lever arm 34. However, the pre-lock tab 68 may be in any desired location on the electrical connector 10. The illustrated pre-lock arm 70 is molded as part of the lever 16, but may be made by any desired method. The illustrated pre-lock arm 70 extends along a pre-lock arm axis 72. As previously described and best shown in FIG. 2 and in detail in FIG. 4, the first housing 12 includes the guide channels 48 in the side walls 22 and 26. When the lever 16 is in the pre-lock position relative to the first housing 12, the pre-lock tab 68 is located in one of the guide channels 48. This can be seen in the cross-sectional view illustrated in FIG. 12 that is taken along line 12-12 of FIG. 6. As shown, the illustrated electrical connector 10 includes two pre-lock tabs 68, one on each lever arm 34. However, the electrical connector 10 may include any desired number of pre-lock tabs 68 in any desired location. Each of the pre-lock tabs 68 is located in a guide channel 48 when the lever 16 is in the pre-stage position. However, the pre-lock tabs 68 may engage any desired feature on the electrical connector 10.

As shown in FIG. 6, when the lever 16 is in the pre-stage position relative to the first housing 12, the pre-lock arm axis 72 is substantially perpendicular to the insertion direction 44. However, the pre-lock arm axis 72 may have any desired orientation. With the pre-lock tab 68 in the guide channel 48, the pre-lock tab 68 engages the first housing 12 to prevent movement of the lever 16 relative to the first housing 12 away from the pre-stage position.

Figure 13:
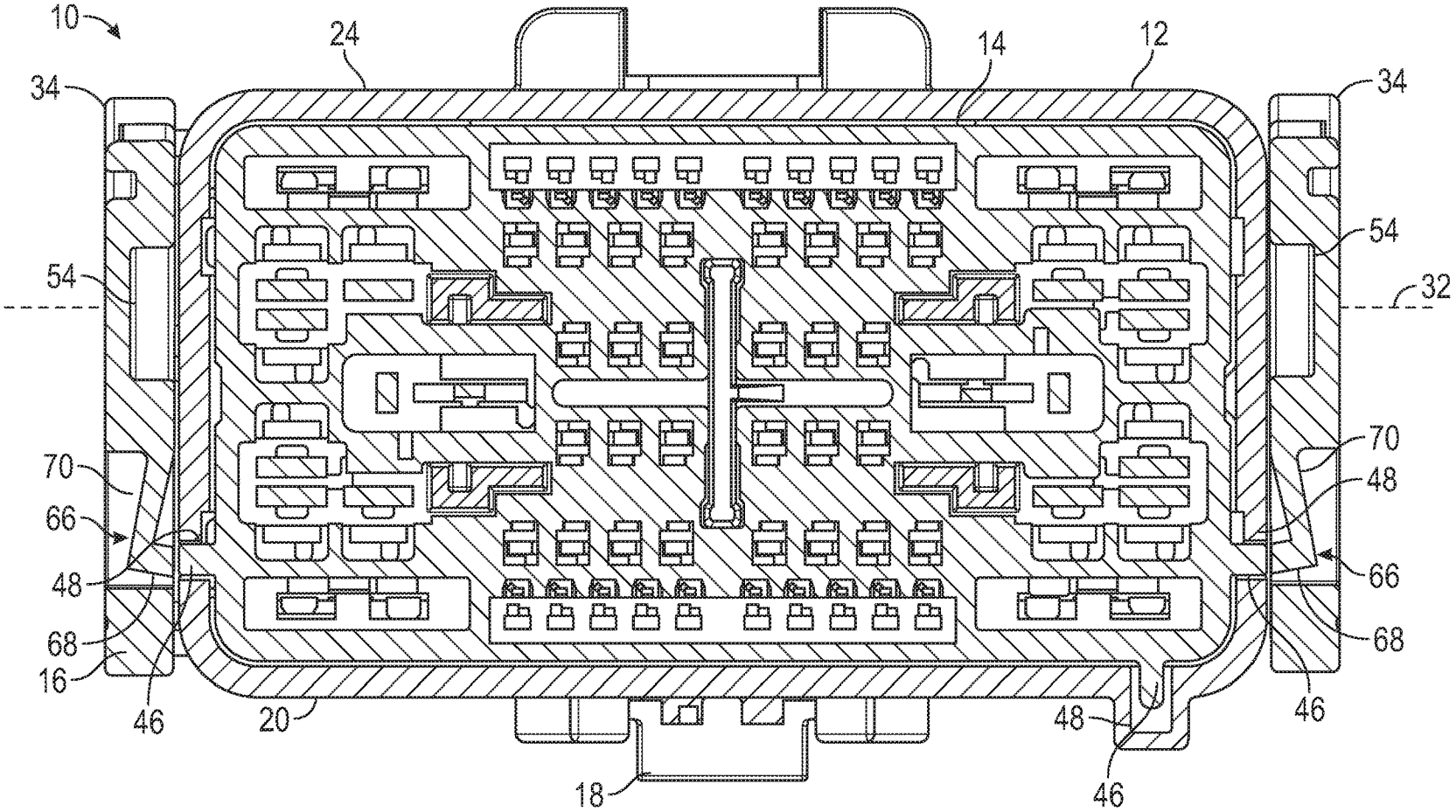
FIG. 13 is a cross-sectional view of the first housing and the second housing, taken along line 13-13 of FIG. 7.

As previously described and illustrated in FIG. 6, the second housing 14 includes the outwardly extending ribs 46. When the second housing 14 is in the pre-stage position relative to the first housing 12 as illustrated in FIG. 7, the ribs 46 are located in respective guide channels 48. This is illustrated in the cross-sectional view shown in FIG. 13, which is taken along line 13-13 of FIG. 7. FIGS. 7 and 13 illustrate the electrical connector 10 when the lever 16 is in the pre-stage position relative to the first housing 12 and the second housing 14 is in the pre-stage position relative to the first housing 12. When the second housing 14 is in the pre-stage position relative to the first housing 12, the ribs 46 displace the pre-lock tabs 68 from the respective guide channels 48, and the pre-lock 66 is released. With the pre-lock 66 released, the lever 16 may be moved in the mate direction 62 away from the pre-stage position.

When the lever 16 is in the pre-stage position relative to the first housing 12 and the second housing 14 is in the pre-stage position relative to the first housing 12, the second housing 14 may also be removed from the first housing 12, as previously described. When the second housing 14 is removed from the first housing 12, the ribs 46 are removed from the respective guide channels 48, and the pre-lock tabs 68 are pushed back into the guide channels 48 by the resilient pre-lock arms 70. Thus, the pre-lock 66 is engaged when the second housing 14 is removed from the first housing 12, and the lever 16 is retained from moving away from the pre-stage position relative to the first housing 12.

Referring back to FIG. 1, the electrical connector 10 includes a lock, indicated generally at 74, that retains the lever 16 in the final position relative to the first housing 12. The illustrated lock 74 includes a latch 76 on the handle 36 of the lever 16 and a catch 78 (shown in FIG. 2) on the first housing 12. However, the lock 74 may be located at any desired location on the electrical connector 10. The illustrated lock 74 engages the catch 78 when the lever 16 is moved to the final position relative to the first housing 12 and retains the lever 16 in the final position relative to the first housing 12. The lock 74 may be disengaged to allow the lever 16 to be moved away from the final position relative to the first housing 12.

Figure 14:
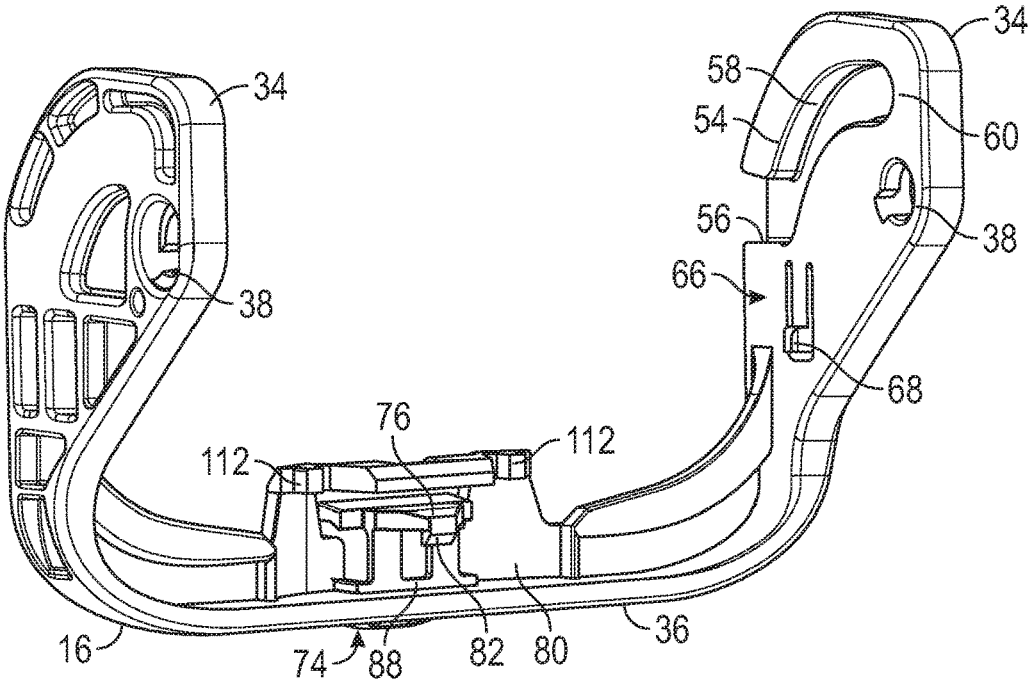
FIG. 14 is a perspective view, taken from behind, of the lever.
Figure 15:
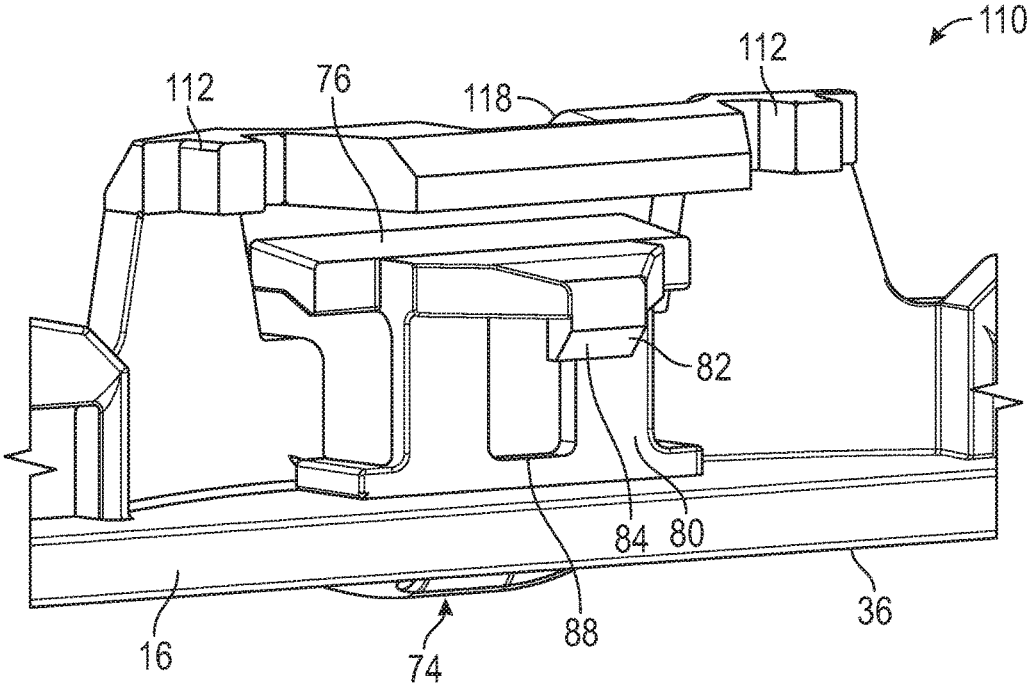
FIG. 15 is an enlarged, detail view of a lock on the lever.

Referring to FIG. 14, a perspective view, from behind, of the lever 16 is illustrated. FIG. 15 is an enlarged view of the handle 36 showing the latch 76. The latch 76 is mounted to the handle 36 by a resilient stand 80 that allows the latch 76 to rotate relative to the handle 36. The lever 16 includes a latch tab 82 with a sloped leading edge 84. The leading edge 84 is the portion of the latch tab 82 that will initially engage the catch 78 when the lever 16 is moved toward the final position.

Figure 16:
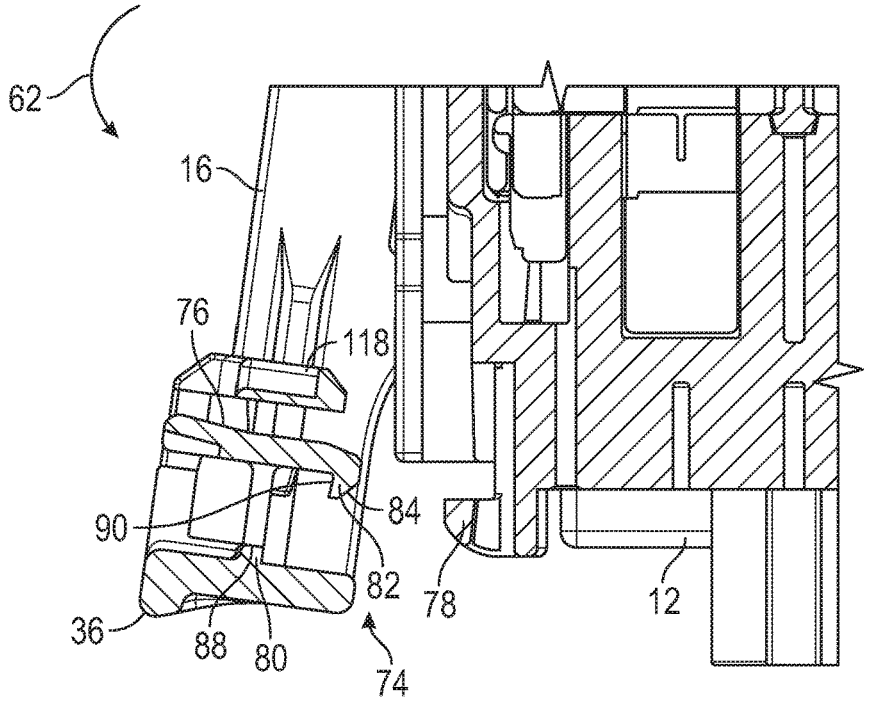
FIG. 16 is a cross-sectional view of the lock and a portion of the first housing, prior to the lever being in the final position relative to the first housing.
Figure 17:
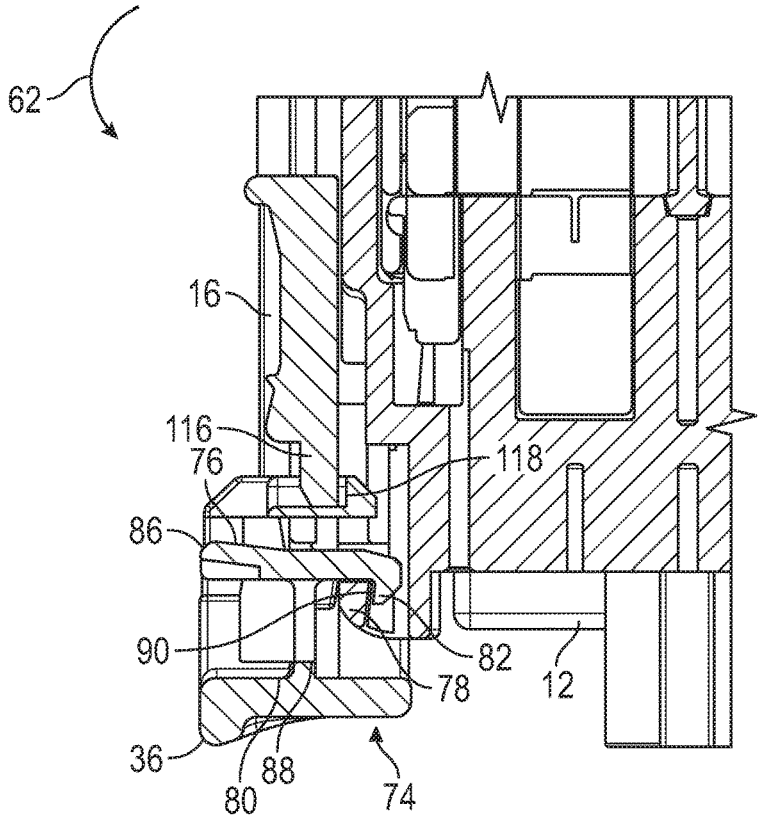
FIG. 17 is a cross-sectional view similar to that illustrated in FIG. 16, shown with the lever in the final position relative to the first housing.

Referring to FIG. 16, a cross-sectional view of the lock 74 is illustrated. The cross-section in FIG. 16 is shown with the lever 16 close to the final position relative to the first housing 12 so that the latch 76 has not engaged the catch 78. FIG. 17 is a cross-sectional view similar to that illustrated in FIG. 16, shown when the lever 16 is in the final position relative to the first housing 12 and the latch 76 has engaged the catch 78. As the lever 16 approaches the final position, the leading edge 84 of the latch tab 82 engages the catch 78. This causes the latch 76 to deflect, allowing the latch tab 82 to move past the catch 78. The latch tab 82 rebounds on the opposite side of the catch 78 and engages the catch 78 to retain the lever 16 in the final position relative to the first housing 12. The lock 74 may be released by the operator by applying pressure to a release end 86 of the latch 76 in order to deflect the latch tab 82 so that it will clear the catch 78 and the lever 16 may be moved away from the final position relative to the first housing 12.

As best seen in FIG. 15, the lock 74 includes a window 88. The illustrated window 88 is defined between a portion of the handle 36, the latch 76, and the stand 80. However, the window 88 may be in any desired location. The window 88 is positioned so that an indicator surface 90 of the latch tab 82 is visible to the operator when the lever 16 is being moved toward the final position. This is best shown in FIG. 16. The indicator surface 90 is the surface of the latch tab 82 facing the window 88, and there is no obstruction between the indicator surface 90 and the window 88. As shown in FIG. 17, when the lever 16 is in the final position, the indicator surface 90 is no longer visible through the window 88. The latch tab 82 has engaged the catch 78, and the catch 78 is between the indicator surface 90 and the window 88. Therefore, the operator may use the indicator surface 90 to determine if the lever 16 is in the final position relative to the first housing 12. In the illustrated embodiment, if the indicator surface 88 is visible through the window 88, the lever 16 is not in the final position.

As previously described and shown in FIG. 2, the electrical connector 10 includes the connector position assurance 18. The illustrated connector position assurance 18 is mounted on the first housing 14, but may be located in any desired location on the electrical connector 10. In the illustrated embodiment, the first housing 12 includes a connector position assurance mount 92, that holds the connector position assurance 18 in position relative to the first housing 12 for movement between an initial position (shown in FIG. 5) and an assurance position (shown in FIG. 1).

Figure 18:
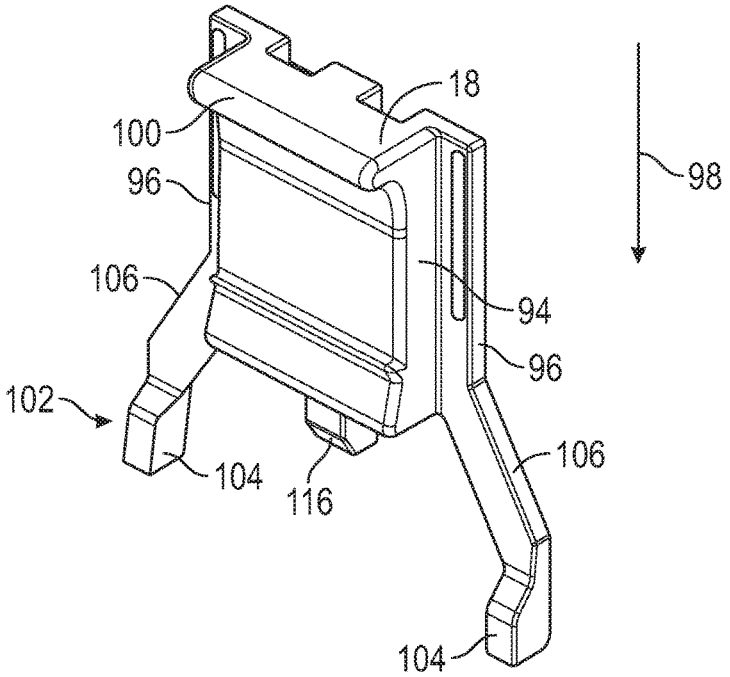
FIG. 18 is a perspective view of a connector position assurance of the electrical connector.

Referring to FIG. 18, a perspective view of the connector position assurance 18 is shown. The illustrated connector position assurance 18 is molded from plastic, but may be made from any desired material and by and desired method. The illustrated connector position assurance 18 includes a body 94. Flanges 96 are located on opposed sides of the body 94 and extend along the body 94 in an assurance direction 98. When the connector position assurance 18 is mounted on the first housing 12, the flanges 96 are engaged by the connector position assurance mount 92 and slide relative to the connector position assurance mount 92. The connector position assurance 18 also includes a push tab 100 that extends from the body 94 and provides a surface that the operator may push against to move the connector position assurance 18 relative to the first housing 12.

Figure 19:
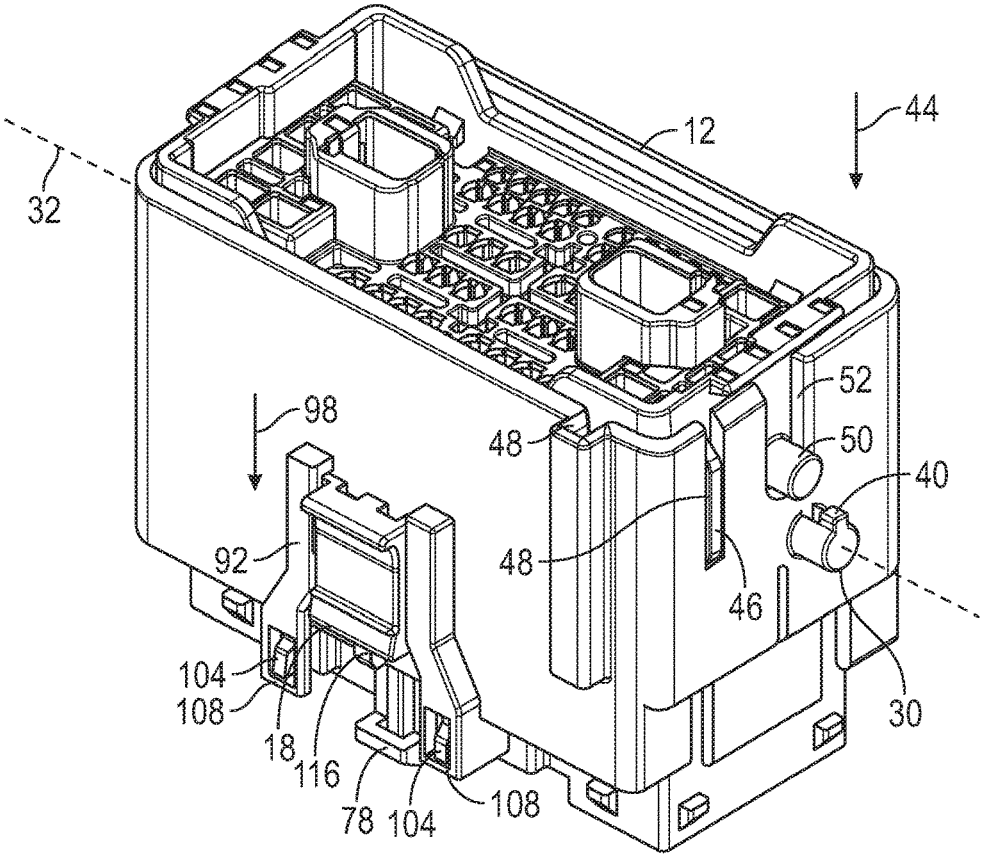
FIG. 19 is an enlarged, perspective view of a portion of the first housing and the connector position assurance.
Figure 20:
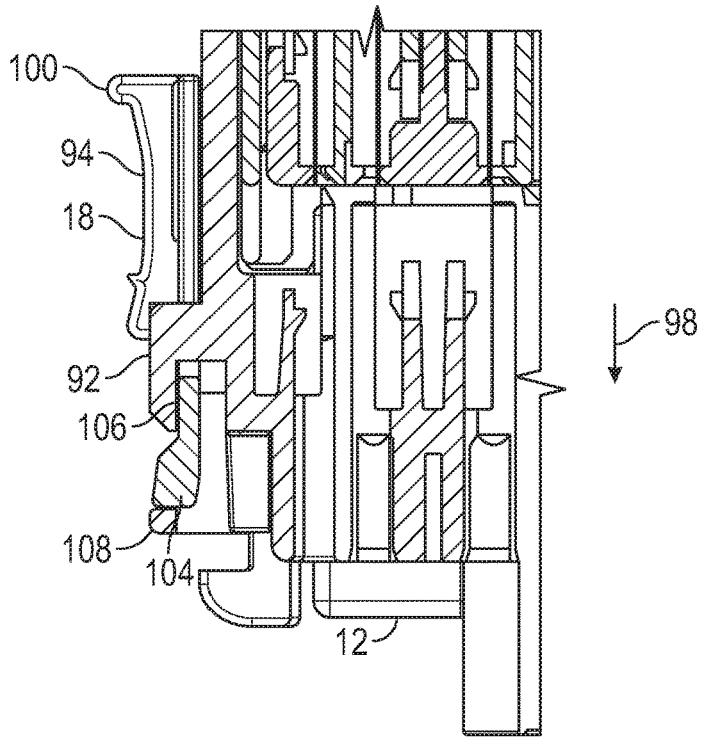
FIG. 20 is a cross-sectional view taken along the line 20-20 of FIG. 5, illustrating the connector position assurance is a pre-locked position relative to the first housing.

The connector position assurance 18 includes a position assurance lock, indicated generally at 102. The illustrated position assurance lock 102 includes two position assurance lock tabs 104 located on respective resilient position assurance arms 106 that extend from the body 94. However, the connector position assurance lock 102 may include any desired number of lock tabs 104 in any desired locations. Referring to FIG. 19, the first housing 12 is illustrated with the connector position assurance 18 shown in the initial position. The illustrated connector position assurance mount 92 includes two position assurance blocks 108, one for each lock tab 104. However, the connector position assurance mount 92 may include any desired number of position assurance blocks 108. FIG. 20 is a cross-sectional view taken along the line 20-20 of FIG. 19 and through one of the position assurance lock tabs 104. As shown, when the connector position assurance 18 is in the initial position, the position assurance lock tabs 104 engage the position assurance blocks 108 to prevent the connector position assurance 18 from being moved in the assurance direction 98.

Figure 21:
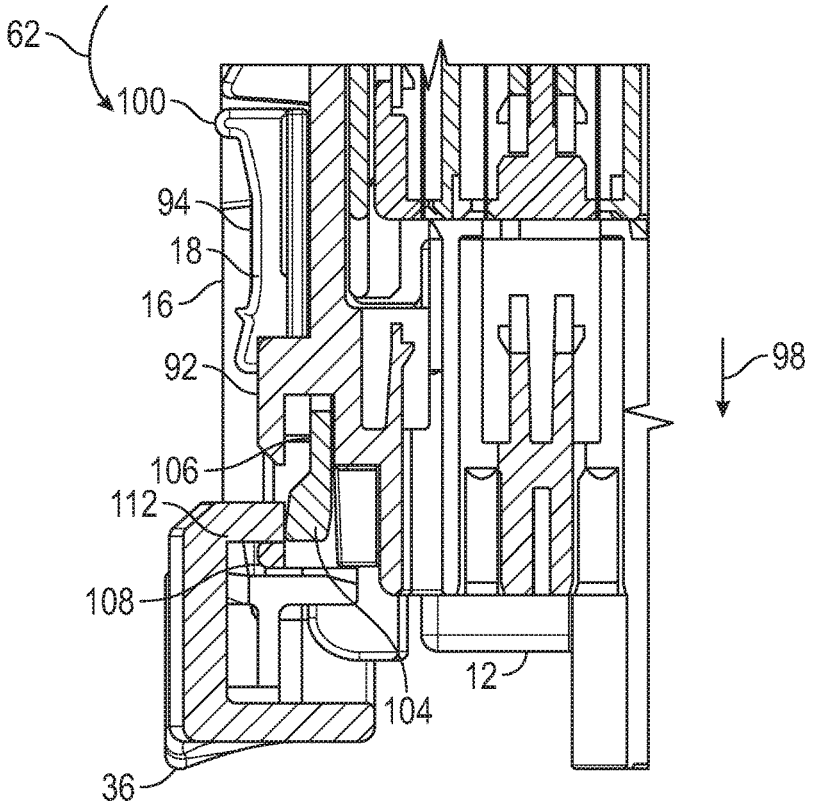
FIG. 21 is a cross-sectional view similar to that illustrated in FIG. 20, shown with the lever in the final position relative to the first housing.

Referring back to FIG. 15, the lever 16 includes a connector position assurance release, indicated generally at 110. The illustrated connector position assurance release 110 includes two release tabs 112 located on the handle 36. However, the connector position assurance release 110 may be in any desired location and may have any desired shape. Referring now to FIG. 21, a cross-sectional view similar to that illustrated in FIG. 20 is shown, with the lever 16 shown in the final position relative to the first housing 12. When the lever 16 is in the final position, the connector position assurance release 110 disengages the position assurance lock 102 so that the connector position assurance 18 may be moved relative to the first housing 12 in the assurance direction 98. The illustrated release tabs 112 engage the position assurance lock tabs 104 and deflect them so that they do not engage the position assurance blocks 108. With the position assurance lock 102 released, the connector position assurance 18 may be moved relative to the first housing 12 in the assurance direction 98.

Figure 22:
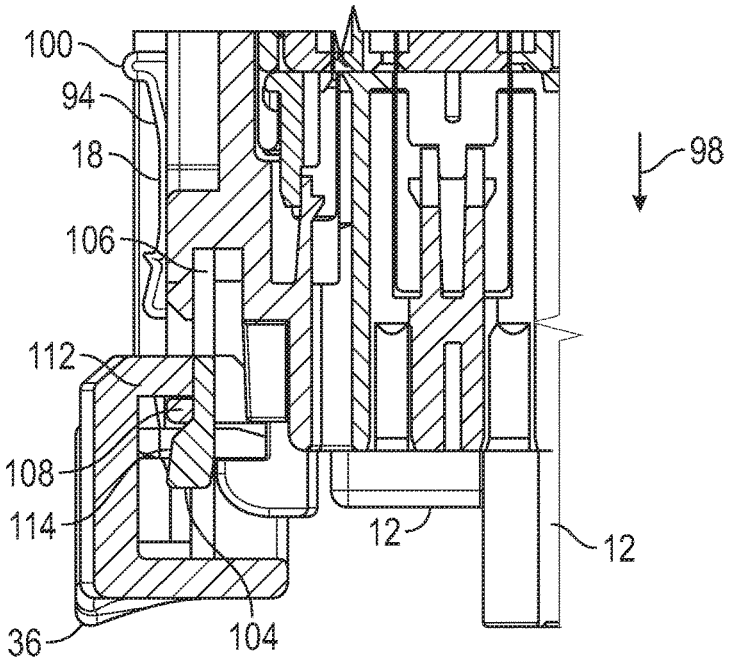
FIG. 22 is a cross-sectional view similar to that illustrated in FIG. 21, shown with the connector position assurance in an assurance position relative to the lever.

Referring to FIG. 22, a cross-sectional view similar to that illustrated in FIG. 21 is shown, with the connector position assurance 18 shown moved relative to the first housing 12 in the assurance direction 98 to the assurance position. As shown, the position assurance lock tab 104 includes a sloped release surface 114 that is engaged with the position assurance block 108. The engagement of the position assurance lock tab 104 with the position assurance block 108 resists movement of the connector position assurance 18 opposite the assurance direction 98, while the slope of the release surface 114 allows the operator to move the connector position assurance 18 opposite the assurance direction if desired.

Figure 23:
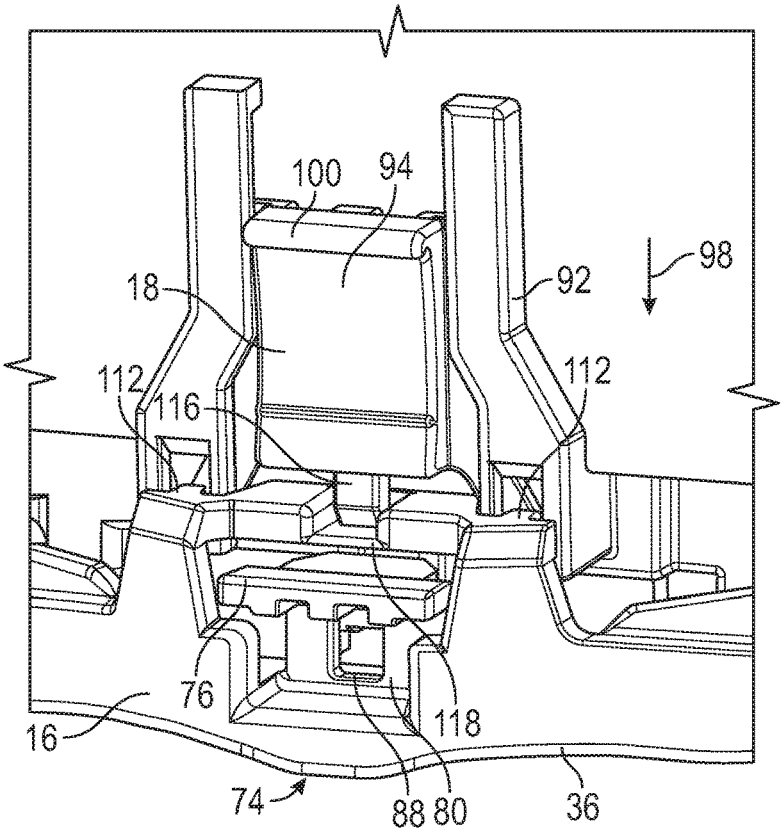
FIG. 23 is an enlarged, perspective, detail view of the connector position assurance, shown in the locked position relative to the lever.

Referring to FIG. 23, an enlarged view of the assembled electrical connector 10 illustrated in FIG. 1 is shown. The electrical connector 10 is shown with the lever 16 in the final position and the connector position assurance 18 in the assurance position. The connector position assurance 18 includes an assurance tab 116 that extends from the body 94 in the assurance direction 98. The lever 16 includes an assurance cradle 118. When the lever 16 is in the final position and the connector position assurance 18 is in the assurance position, the assurance tab 116 is adjacent the assurance cradle 118. If the lever 16 is moved from the final position, the assurance cradle 118 engages the assurance tab 116, and the lever 16 is prevented from being moved away from the final position. The connector position assurance 18 may be released by moving the connector position assurance 18 opposite the assurance direction 98 so that the assurance tab 116 is no longer adjacent the assurance cradle 118. The lever 16 may then be moved away from the final position.

The illustrated connector position assurance 18 acts as a connector position assurance. If the lever 16 is not in the final position relative to the housing 12, the connector position assurance 18 will not be able to move to the assurance position. Thus, the operator will know that the first housing 12 and the second housing 14 are not fully mated. Additionally, the illustrated connector position assurance 18 acts as a secondary lock for the lever 16. If the lock 74 is damaged, for example, by the latch 76 being broken or fatigued, the lever 16 may be retained in the final position relative to the first housing 12 by the engagement of the connector position assurance 18 with the lever 16.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector comprising:

a first housing;

a second housing movable relative to the first housing;

a lever mounted on the first housing for relative rotational movement between a pre-stage position and a final position, the lever engaging the second housing to move the second housing in an insertion direction between a pre-stage position and a seated position relative to the first housing;

a pre-lock that, when the lever is in the pre-stage position, extends from the lever in a direction that is perpendicular to the insertion direction and that normally retains the lever in the pre-stage position relative to the first housing; and a pre-lock release on the second housing that is oriented to engage the pre-lock in a direction that is perpendicular to the direction that the pre-lock extends from the lever and thereby release the pre-lock when the second housing is in the pre-stage position relative to the first housing to allow movement of the lever relative to the first housing.

2. The electrical connector of claim 1, further comprising a guide channel on the first housing, wherein the pre-lock on the lever is located in the guide channel when the lever is in the pre-stage position to retain the lever in the pre-stage position; and wherein the pre-lock release on the second housing displaces the pre-lock from the guide channel when the second housing is in the pre-stage position to release the lever for movement relative to the first housing.

3. The electrical connector of claim 1, wherein the pre-lock includes a tab on an end of a resilient arm that extends from the lever in the direction that is perpendicular to the insertion direction.

4. The electrical connector of claim 1, further comprising a travel peg on the second housing that is engaged by the lever to move the second housing linearly between the pre-stage position and the seated position relative to the first housing.

5. The electrical connector of claim 4, wherein the pre-lock release moves in the guide channel when the second housing is moved between the pre-stage position and a seated position relative to the first housing, and wherein the travel peg moves in a peg channel on the first housing when the second housing is moved between the pre-stage position and the seated position relative to the first housing.

6. The electrical connector of claim 5, wherein the lever rotates relative to the first housing about a lever axis, and wherein the peg channel is closer to the lever axis than the guide channel.

7. An electrical connector comprising:

a first housing having a plurality of elongated guide channels provided therein that extend in an insertion direction;

a second housing having a plurality of elongated guide ribs provided thereon that extend in the insertion direction and cooperate with the plurality of elongated guide channels to prevent incorrect positioning of the second housing relative to the first housing and to maintain proper alignment between the second housing and the first housing when the second housing is moved in the insertion direction from a pre-stage position relative to the first housing toward a seated position relative to the first housing;

a lever mounted on the first housing for relative rotational movement between a pre-stage position and a final position, the lever engaging the second housing to move the second housing in the insertion direction between the pre-stage position and the seated position relative to the first housing;

a pre-lock arm that extends from the lever in a direction that is perpendicular to the insertion direction when lever is in the pre-stage position, the pre-lock arm cooperating with one of the plurality of elongated guide channels and that normally retains the lever in the pre-stage position relative to the first housing; and a pre-lock release on the second housing that is oriented to engage the pre-lock in a direction that is perpendicular to the direction that the pre-lock extends from the lever and thereby release the pre-lock arm when the second housing is in the pre-stage position relative to the first housing to allow movement of the lever relative to the first housing.

8. The electrical connector of claim 7, wherein the pre-lock includes a tab on an end of a resilient arm that extends from the lever in the direction that is perpendicular to the insertion direction.

9. The electrical connector of claim 7, further comprising a travel peg on the second housing that is engaged by the lever to move the second housing linearly between the pre-stage position and the seated position relative to the first housing.

10. The electrical connector of claim 9, wherein the pre-lock release moves in the guide channel when the second housing is moved between the pre-stage position and a seated position relative to the first housing, and wherein the travel peg moves in a peg channel on the first housing when the second housing is moved between the pre-stage position and the seated position relative to the first housing.

11. The electrical connector of claim 10, wherein the lever rotates relative to the first housing about a lever axis, and wherein the peg channel is closer to the lever axis than the guide channel.

* * * * *